US005241728A

United States Patent [19]

Hunter

[11] Patent Number: 5,241,728

[45] Date of Patent: Sep. 7, 1993

[54] RESILIENT CLIP

[75] Inventor: Thomas Hunter, Elmhurst, Ill.

[73] Assignee: Selfix, Inc., Chicago, Ill.

[21] Appl. No.: 895,348

[22] Filed: Jun. 8, 1992

[51] Int. Cl.[5] ..... A44B 21/00

[52] U.S. Cl. ..... 24/511; 24/565

[58] Field of Search ..... 24/501, 507, 511, 530, 24/565; 223/91, 93, 96

[56] References Cited

U.S. PATENT DOCUMENTS

| | | |
|---|---|---|
| Re. 32,269 | 10/1986 | Bisk et al. . |
| D. 175,169 | 7/1955 | Jacobson . |
| D. 251,345 | 3/1979 | Bigelow et al. . |
| D. 264,662 | 6/1982 | Bisk et al. . |
| D. 301,661 | 6/1989 | Wilson . |
| D. 307,833 | 5/1990 | Maki . |
| D. 316,333 | 4/1991 | Maki . |
| 454,579 | 6/1891 | Lamb . |
| 1,151,556 | 8/1915 | Barney . |
| 1,358,560 | 11/1920 | Kennison . |
| 1,684,721 | 9/1928 | Wood . |
| 1,750,905 | 3/1930 | Schilpp . |
| 1,893,508 | 3/1930 | Rosenberg . |
| 1,905,958 | 4/1933 | Bogley . |
| 2,496,109 | 1/1950 | Terry . |
| 2,506,510 | 5/1950 | Longwell et al. . |
| 2,583,784 | 1/1952 | Maccaferri . |
| 2,583,996 | 1/1952 | Cavanagh . |
| 2,613,857 | 10/1952 | Pechtel . |
| 2,666,240 | 1/1954 | Maccaferri . |
| 2,782,482 | 2/1957 | Baril et al. . |
| 2,802,610 | 8/1957 | De Lier . |
| 3,018,026 | 1/1962 | Binkley et al. . |
| 3,203,061 | 8/1965 | Thomas . |
| 3,214,813 | 11/1965 | Goldman . |
| 3,239,902 | 3/1966 | Cohen . |
| 3,456,262 | 7/1969 | Coon . |
| 3,950,829 | 4/1976 | Cohen . |
| 4,382,531 | 5/1983 | Bisk et al. . |
| 4,660,750 | 4/1987 | Blanchard . |
| 4,701,983 | 10/1987 | Warmath . |
| 4,878,276 | 11/1989 | Morrish et al. ..... 24/511 |

FOREIGN PATENT DOCUMENTS

| | | |
|---|---|---|
| 982150 | 6/1951 | France ..... 24/501 |
| 1159796 | 7/1958 | France . |
| 1210426 | 3/1960 | France . |
| 348684 | 5/1937 | Italy . |
| 7306492 | 11/1974 | Netherlands . |
| 277009 | 11/1951 | Switzerland . |
| 278907 | 2/1952 | Switzerland . |
| 352309 | 4/1961 | Switzerland . |
| 504574 | 4/1971 | Switzerland . |
| 593125 | 10/1947 | United Kingdom . |
| 697866 | 9/1953 | United Kingdom . |
| 714990 | 9/1954 | United Kingdom . |
| 731906 | 6/1955 | United Kingdom . |

*Primary Examiner*—James R. Brittain

*Attorney, Agent, or Firm*—Dressler, Goldsmith, Shore, Sutker & Milnamow, Ltd.

[57] ABSTRACT

A spring clip having a pair of jaws and a spring or biasing member interconnecting the jaws for biasing the jaws to a closed position, the spring including a support ledge defining a fulcrum for rotation of the jaws between the open and closed position independently of any separate support member.

8 Claims, 2 Drawing Sheets

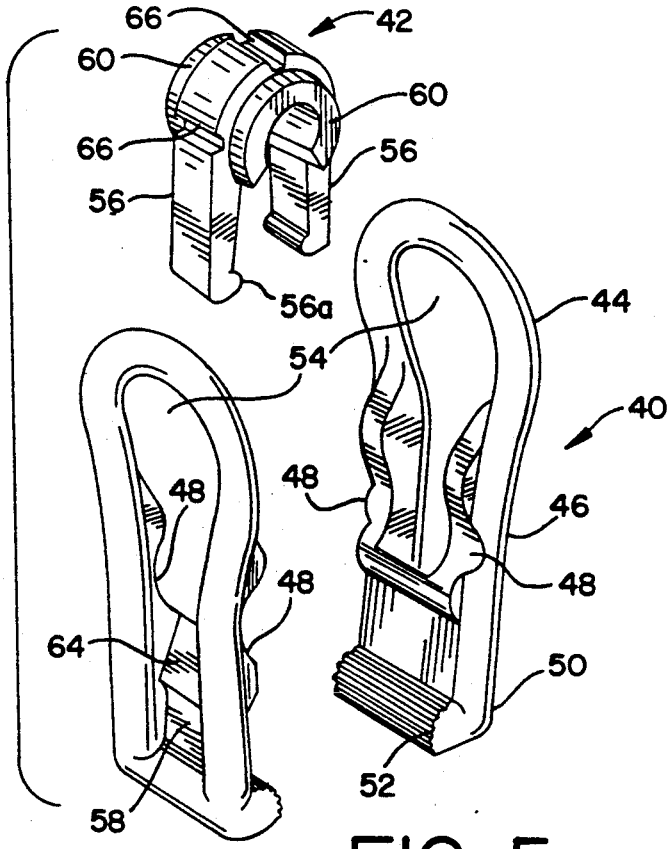
FIG. 3
FIG. 4
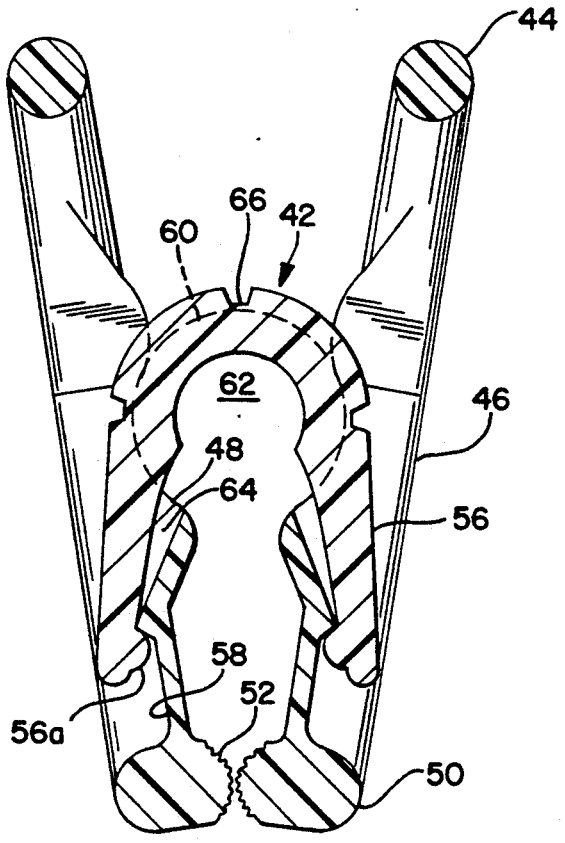
FIG. 5
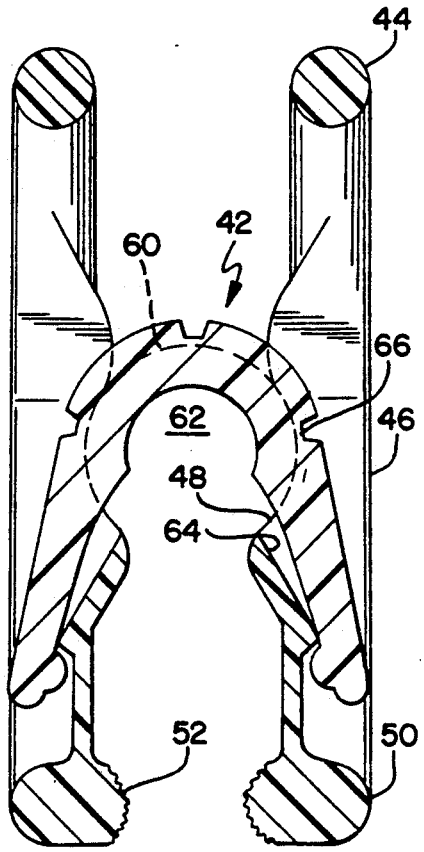

RESILIENT CLIP

FIELD OF THE INVENTION

This invention relates generally to clips and more particularly to clips capable of being used while attached to a support member such as a hanger and independently thereof.

BACKGROUND OF THE INVENTION

There exists a variety of spring type clips of various configurations. Many such clips are designed to be pivotally attached to a support member such as a rod portion of a hanger which acts as not only the pivot, but also as a support for the components of the clip which interacts therewith. Examples of such clips are disclosed in Bisk et al. U.S. Pat. No. Re-32,269 and Morrish et al. U.S. Pat. No. 4,878,276.

Typically, spring clips designed to engage a support member such as the crossbar of a hanger are constructed to require the utilization of such a crossbar for the clip to function as intended. If the clip is not assembled to the crossbar of a hanger, a substitute support is necessary in order to provide a fulcrum about which components of the clip pivot.

Alternatively, when efforts have been made to provide a spring clip of the type which does not require a support rod to provide a fulcrum therefor, a separate fulcrum point is provided which is displaced from the axis of rotation, e.g., the rod about which the jaws are supported. The unreliability and complexity of such constructions which are intended to enable operation with and without such a support member have detracted from their usefulness and from their satisfactory operation.

It would be highly desirable therefore to provide a spring clip of the type capable of being supported on and pivoting about a support member or capable of operating totally independently thereof while continuing to pivot about the same axis of rotation provided by the components of the spring clip.

SUMMARY OF THE INVENTION

In accordance with the present invention, there is provided a spring clip having a minimum number of parts capable of being assembled to pivot about an axis which remains unchanged whether or not the clip is attached to a separate support member. A spring clip incorporating the present invention is operative with and without such a support member such as a rod of a hanger or other similar support.

Therefore, a spring clip incorporating the present invention does not require a separate support member and thus obviates the need for additional components or separate embodiments when used with and without such supporting structures.

In accordance with the present invention, there is provided a spring clip of the type having a pair of jaws typically constructed of a plastic material, and resilient biasing means or spring member engageable with each of said jaws for applying a spring force to close the gripping ends of the jaws and provide a gripping force at the nip therebetween and providing a fulcrum about which the jaws pivot.

Each of the jaws includes an arcuate portion which engages and pivots about a fulcrum portion of the integral spring member for permitting pivotal movement thereabout. The biasing means or spring is generally U-shaped member having a pair of resilient legs engageable with the cuter surface of the jaws to force the gripping ends of the jaws towards each other and resiliently engageable therewith to permit separation of the jaws upon pressure applied to the opposite ends thereof.

The integral biasing means or spring member incorporating the present invention incorporates a shoulder defining curvilinear fulcrum surface in the vicinity of the U-shaped head or end portion of the spring extending outwardly from either side thereof. The curvilinear fulcrum surface is engageable with the corresponding curvilinear portions of each of the jaws located intermediate the opposite ends thereof.

The inside of the generally U-shaped biasing member is configured and sized to receive standard size rods, e.g., a typical plastic hanger. The outer surfaces of the fulcrum portions provide a pivot support for each of the jaws engaged therewith.

Thus, the spring clip incorporating the present invention includes a minimal number of parts, and pivots about its axis of rotation independently of any external support member, but is capable of being used with such a support which also is positioned along the pivot axis of rotation of the clip when assembled thereto.

Numerous other features and advantages of the present invention will become readily apparent from the following detailed description of the invention and an embodiment thereof, from the claims, and from the accompanying drawings in which the details of the invention are fully and completely disclosed as a part of this specification.

BRIEF DESCRIPTION OF THE DRAWINGS

FIG. 3 is an exploded perspective view of a clip incorporating the present invention;

FIG. 4 is an enlarged sectional view taken along lines 4—4 of FIG. 2; and FIG. 5 is a view similar to FIG. 4 showing the clip with the gripping portions opened.

DETAILED DESCRIPTION OF A PREFERRED EMBODIMENT

Figure 1:
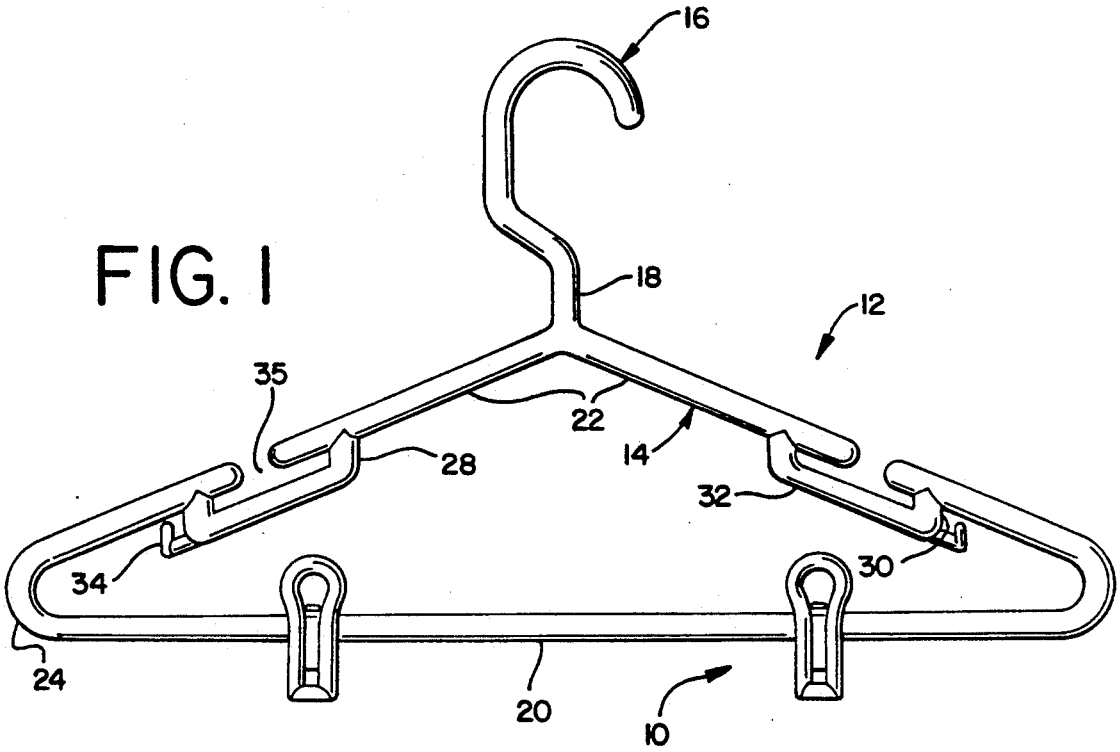
FIG. 1 is a plan view of an all plastic hanger showing the engagement therewith of a spring clip constructed in accordance with an aspect of the present invention.
Figure 2:
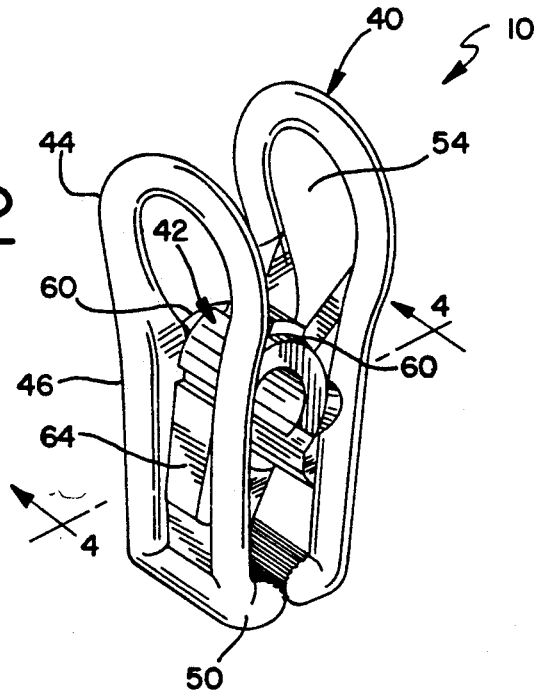
FIG. 2 is a perspective view of a spring clip incorporating the present invention.

While the present invention is susceptible of embodiment in various forms, there is shown in the drawings, and will hereinafter be described, a preferred embodiment of the invention with the understanding that the present disclosure is to be considered as an exemplification of the principles of the invention and is not intended to limit the invention to the specific embodiment illustrated.

Referring to the drawings, a clip 10 incorporating the present invention is typically used in conjunction with a plastic hanger 12 or other support member shown in FIG. 1. Such a hanger may be as shown in the aforementioned reissue U.S. Pat. No. Re-32,269 and typically includes a body portion 14 and a supporting hook portion 16 connected thereto for supporting or suspending the body portion from a support such as a curtain rod (not shown) as is well known.

Typically, a hanger such as shown in FIG. 1 is cylindrical in cross-section. The body portion 14 basically comprises an upstanding neck or stem portion 18, a cross bar 20, and a pair of arms 22. The arms 22 merge together at the stem portion 18 and diverge downwardly and outwardly therefrom. Each of the arms 22 joins to a respective end of the cross bar 20 at a rounded shoulder 24. The stem 18 terminates in the hook 16 as shown.

As is conventional, the diverging arms 22 serve as a means for supporting a jacket or similar garment. The diverging arms may also include a slot 26 formed by a pair of downward extensions 28, 30 and a cross piece 32 with a small hook 34 projecting outwardly from one of the extensions. A gap 35 in each arm 22 provides access to the slot 26 for supporting garments of the type having straps as is known, and as described in the aforementioned reissue patent.

Hangers such as shown in FIG. 1 may be used with spring clips attached thereto as is well known. Typically, the clips have been as disclosed in the aforementioned reissue patent which utilized the cross bar 20 as an integral support with the clip being assembled to the cross bar for support thereon and pivoting thereabout.

While the clip 10 incorporating the present invention may be similarly attached to the cross bar 20 of a hanger 12 or other support member, the clip 10 is independently assembled and operable without the use of or necessity for such a support member. Thus, the clip 10 incorporating the present invention utilizes a pair of substantially identical jaw members 40 and a resilient biasing means or spring member 42 connecting the jaws together and for defining a support and fulcrum about which the assembled jaws pivot as described below.

Each of the jaws 40 is formed of a plastic material such as polypropylene, while the spring member 42 or biasing means may be formed from a different material such as polycarbonate as is known. Alternative materials may also be utilized.

Each of the jaws 40 is formed as a substantially planar member with an enlarged first manually actuatable end portion 44, an intermediate portion 46 defining a pair of arcuate surfaces 48, and a second gripper end portion 50. The gripper end 50 of each of the jaw members 40 includes a projection 52 which may have its surface roughened or serrated to improve the gripping action thereof as is known.

The jaws 40 are disposed as is known side-by-side with the first manually actuatable end portions 44 each defining an opening 54 for receiving the legs 56 of the U-shaped biasing means or spring member 42. The legs 56 pass through the openings 54 with the free ends 56*a* of the legs 56 engaging a recess or detent 58 formed in the outer surfaces of each of the jaws 40 adjacent the second gripper end portion 50.

The width of the body of the biasing means 42 is such as to pass between the intermediate arcuate surfaces or curvilinear portions 48 to allow passage of the legs 56 through the openings 54 formed in each of the jaws from between the jaws and over the outer surface thereof. The legs 56 each engage the detent 58 formed adjacent the second gripper end portion 50.

The spring member or biasing means 42 includes a pair of arcuate support surfaces or ledges 60 on either side thereof which define a fulcrum and pivot surface for the jaws 40. Each of the support surfaces or ledges 60 extends laterally out from the sides of the U-shaped head or end portion of the spring member and engage the corresponding opposed arcuate intermediate surfaces 48 formed in the intermediate portions 46 of each of the jaw members 40 as shown in the drawing.

The biasing means 42 defines an arcuate recess or axial opening 62 formed therewithin which extends along the axis of rotation. The axial recess 62 formed in the spring means 42 is adapted to permit insertion of a suitable support member into the assembled clip and retention thereon when it is desired to utilize the clip in conjunction therewith. As is evident, however, the assembled clip 10 is independently operable by virtue of the jaws 40 pivoting around the arcuate fulcrum defining ledges 60 formed as a part of the biasing means 42.

The opposed second end portions 50 of the jaws 40 form a nip of the clip with gripper portions or projections 52 engageable against each other to retain an article therebetween. The opposite manually actuatable end portions 44 of the jaws 40 are designed to be grasped and pressed together to open the gripper ends 50 and permit insertion of an article therebetween. Upon release of the pressure applied to the manually actuatable ends 44, the biasing means or spring member 42 effects rotation or pivoting movement of the jaw members 40 on the ledges 60 about the axis of rotation to force the gripper ends 50 of the jaws 40 towards each other to close.

The outer surface of the intermediate portion of each jaw includes an incline or ramped surface portion 64 extending from the edge of the opening 54 to the detent 58.

Because the arcuate ledges 60 defining the fulcrum are formed integrally with the biasing means 42, the free ends 56*a* of the spring member legs 56 are not locked in place when the clip is assembled, but are permitted to move longitudinally within the detent 58 as the spring clip is manipulated and opened and closed as shown in FIGS. 4 and 5. The bias means may include a plurality of stress relieving notches 66.

Once assembled, the clip can be readily snapped onto a suitable support member such as a hanger cross bar. Alternatively, since the clip when assembled is operable without any separate support member, an alternative attachment means can be utilized to support the clip separately on a support surface such as a wall or allowing the clip to be hung directly from a hook passing through the aperture formed in the manually actuatable end thereof.

Thus, there has been disclosed a spring clip of the type utilizing a pair of jaws and a spring or bias member to maintain the jaws in a normally closed position which spring also defines a support and fulcrum for the jaws to permit pivoting movement thereof between the open and close positions. The spring includes a pair of integral arcuate ledges supporting a corresponding arcuate portion of the jaws thereon in operation thereof independently separate supporting member while permitting pivotal movement of the jaws about the same axis of rotation whether supported on a support member or independently thereof.

In addition to being able to operate independently of any support member, the clip incorporating the present invention utilizes the same components separately whether supported on a separate support member operated independently, or otherwise attached to a surface in alternative ways. Because of the simplified structure of the clip incorporating the present invention, and no separate support member or substitute therefor is required in order to provide the necessary fulcrum and pivot surface about which the jaws rotate and on which the jaws may be supported.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A clip comprising:

a pair of jaw members each having a first gripping end portion adapted to engage the corresponding first gripping end portion of the other jaw member for gripping an article or object therebetween;

a second end portion defining a manually actuatable portion; and an intermediate portion defining a pair of laterally spaced apart arcuate surfaces;

a generally U-shaped resilient biasing member engageable with said jaw members for resiliently urging said first end portions into engagement with each other, said biasing member having a pair of legs and a curvilinear base portion integral with and joining said legs, and having a width adapted to fit between said intermediate portions of said jaw members, said legs extending respectively along the outer surface of said intermediate jaw portions with the free ends of said legs engageable with said jaw members at a position adjacent to said first gripping end portions with said curvilinear base portion extending between said jaw members, and a curvilinear support portion extending laterally out form and integral with said biasing member adjacent said curvilinear base portion and engageable by said arcuate surfaces of said intermediate portions of said jaws for defining a fulcrum therefor about an axis of rotation passing between said legs and within said curvilinear base portion, said jaw members pivoting about said axis of rotation along the surface of said fulcrum for separating said first end portions in response to pressure on said second end portions one towards the other and for moving said first end portions towards each other when said second manually actuatable end portions are released.

2. A clip comprising:

a pair of jaw members; and a generally U-shaped fulcrum defining spring member engageable therewith, said spring member defining a pair of legs connected by an integral arcuate central portion defining an arcuate recess therebetween, and arcuate ledge portions forming a part of and extending out from the opposite sides of said arcuate central portion defining a pair of opposed fulcrum support surfaces;

each of said jaw members defining a pair of arcuate surfaces intermediate the ends thereof, said intermediate arcuate jaw surfaces engageable with the surfaces of said arcuate ledge portions of said spring member with the legs of said spring member passing from between said jaw members to engage the outer surfaces thereof with the free ends of said legs of said spring member engageable with the outer surfaces of said jaw members adjacent first ends thereof for biasing said first ends towards each other to engage said first ends one with the other, said jaw members being operated by pressure applied to the opposite ends thereof for pivoting said jaw members about said arcuate ledge portions with the axis of rotation passing through said arcuate recess within said spring member.

3. A clip as claimed in claim 2 wherein said generally U-shaped spring member includes a plurality of notches formed in the outer surfaces thereof.

4. A clip as claimed in claim 2 including an opening formed in each of said jaw members between said arcuate surfaces thereof to permit the passage of one of said legs of said spring member from between said jaw members to position the free ends of said legs on the outer surface of said jaw members adjacent said first ends.

5. A clip as claimed in claim 2 wherein each of said jaw members has an elongated recess formed in the outer surface thereof adjacent the first end thereof and wherein said free ends of said legs of said spring member; each includes a portion engageable in said recess.

6. A clip as claimed in claim 5 wherein the free end of each of said legs of said spring member is movable longitudinally within said elongated recess formed in the outer surface of said jaw member as said jaw member pivots about said fulcrum defining arcuate ledge portions.

7. A clip as claimed in claim 2 wherein said arcuate recess defined by said spring member is adapted to receive a rod member for selectively supporting said clip on a rod member inserted within said arcuate recess.

8. A clip comprising:

a pair of jaw members each having a first gripping end portion, a second end portion, and a curvilinear intermediate portion;

a one-piece generally U-shaped resilient biasing member engageable with said jaw members for resiliently urging said first gripping end portions into engagement with each other;

said biasing member including a pair of legs and a curvilinear end portion integral with and joining said legs, said curvilinear end portion and a portion of the legs of said biasing member being disposed between said jaw member and a portion of said legs extending to a point respectively along the outer surfaces of said jaw members with the free ends of each of said legs engageable with said outer surface of said jaw members at a position adjacent to said first end portions thereof, said U-shaped resilient biasing member further including a curvilinear support portion integral with and extending laterally out from either side of said biasing member adjacent said curvilinear end portion;

the intermediate portions of said jaw members shaped to rotatably engage the surface of said curvilinear support portion of said biasing member which defines a fulcrum therefor about an axis of rotation passing between said leg portions and within said curvilinear end portion of said biasing member, said jaw members being pivotal about said axis of rotation along the surface of said fulcrum defining curvilinear support portions in response to pressure applied to said second end portions, one toward the other for separating said first end portions and for effecting movement of said first end portions towards each other when said second end portions are released.

* * * * *